United States Patent [19]

Mozer et al.

[11] 4,384,170

[45] May 17, 1983

[54] METHOD AND APPARATUS FOR SPEECH SYNTHESIZING

[75] Inventors: Forrest S. Mozer, 38 Sumerset Pl., Berkeley, Calif. 94707; Richard P. Stauduhar, Berkeley, Calif.

[73] Assignee: Forrest S. Mozer, Berkeley, Calif.

[21] Appl. No.: 89,074

[22] Filed: Oct. 29, 1979

Related U.S. Application Data

[60] Division of Ser. No. 761,210, Jan. 21, 1977, Pat. No. 4,214,125, which is a continuation of Ser. No. 632,140, Nov. 14, 1975, abandoned, which is a continuation-in-part of Ser. No. 525,388, Nov. 20, 1974, abandoned, which is a continuation-in-part of Ser. No. 432,859, Jan. 14, 1974, abandoned.

[51] Int. Cl.[3] ..... G10L 1/00

[52] U.S. Cl. ..... 179/1 SM

[58] Field of Search ..... 179/1 SM, 1 SA, 1 SG; 84/1.01, 1.03; 375/27, 28; 455/72; 332/11 D; 358/135, 261

[56] References Cited

U.S. PATENT DOCUMENTS

| | | | |
|---|---|---|---|
| 3,102,165 | 8/1963 | Clapper | 179/1 SG |
| 3,553,362 | 1/1971 | Mounts | 358/261 |
| 3,598,921 | 8/1971 | Paine | 179/15.55 R |
| 3,609,244 | 9/1971 | Mounts | 179/15.55 R |
| 3,641,496 | 2/1972 | Slavin | 179/1 SM |
| 3,727,005 | 4/1973 | Franaszek | 370/118 |
| 3,789,144 | 1/1974 | Doyle | 179/15.55 R |
| 3,828,132 | 8/1974 | Flanagan et al. | 179/1 SM |
| 3,892,919 | 7/1975 | Ichikawa | 179/1 SM |
| 4,047,108 | 9/1977 | Bijker et al. | 455/72 |

*Primary Examiner*—Emanuel S. Kemeny

*Attorney, Agent, or Firm*—Townsend and Townsend

[57] ABSTRACT

A speech synthesizer including a device for storing compressed digital signals corresponding to original information speech or audio waveform time domain signals, the digital signals including information signal portions and instruction signal portions identifying particular compression techniques applied to associated information signal portions; an output terminal for manifesting analog electrical synthesized signals corresponding to the original signals; a digital-to-analog converter having an output coupled to the output terminal and an input; and an intermediate signal processing circuit having an input coupled to the storage device and an output coupled to the digital-to-analog converter for expanding the information signal portions in accordance with the instruction signal portions to produce digital synthesized signals to be converted to analog synthesized signals by the digital-to-analog converter.

11 Claims, 10 Drawing Figures

METHOD AND APPARATUS FOR SPEECH SYNTHESIZING

CROSS-REFERENCES TO RELATED APPLICATIONS

This application is a division of co-pending application Ser. No. 761,210, filed Jan. 21, 1977 entitled "METHOD AND APPARATUS FOR SPEECH SYNTHESIZING," now U.S. Pat. No. 4,214,125 issued July 22, 1980, which is a continuation of application Ser. No. 632,140, filed Nov. 14, 1975 entitled "METHOD AND APPARATUS FOR SPEECH SYNTHESIZING," now abandoned, which is a continuation-in-part of application Ser. No. 525,388, filed Nov. 20, 1974, entitled "METHOD AND APPARATUS FOR SPEECH SYNTHESIZING," now abandoned, which, in turn, is a continuation-in-part of application Ser. No. 432,859, filed Jan. 14, 1974, entitled "METHOD FOR SYNTHESIZING SPEECH AND OTHER COMPLEX WAVEFORMS," which was abandonded in favor of application Ser. No. 525,388.

INCORPORATION BY REFERENCE

The entire disclosure of commonly owned, allowed co-pending patent application Ser. No. 761,210, filed Jan. 21, 1977 entitled "METHOD AND APPARATUS FOR SPEECH SYNTHESIZING" now U.S. Pat. No. 4,214,125 issued July 22, 1980, is hereby incorporated by reference.

FIELD OF THE INVENTION

The present invention relates to speech synthesis and more particularly to a method for analyzing and synthesizing speech and other complex waveforms using basically digital techniques.

SUMMARY OF THE INVENTION

The invention comprises an apparatus for synthesizing speech or other complex waveforms from compressed digital signals prepared from original information speech or other audio waveform signal by time differentiating electrical signals representative of the complex speech waveforms, time quantizing the amplitude of the electrical signals into digital form, and selectively compressing the time quantized signals by one or more predetermined techniques using a human operator and a digital computer which discard portions of the time quantized signals while generating instruction signals as to which of the techniques have been employed. Both the compressed, time quantized signals and the compression instruction signals are stored in the memory of a solid state speech synthesizer and are selectively retrieved to reconstruct selected portions of the original complex waveform.

In the preferred embodiments the compression techniques used by a computer operator in generating the compressed speech information and instruction signals to be loaded into the memories of the speech synthesizer circuit from the computer memory take several forms which are discussed in greater detail in the referenced parent application. Briefly summarized, these compression techniques are as follows. The technique termed "X period zeroing" comprises the steps of deleting preselected relatively low power fractional portions of the input information signals and generating instruction signals specifying those portions of the signals so deleted which are to be later replaced during synthesis by a constant amplitude signal of predetermined value, the term "X" corresponding to a fractional portion of the signal thus compressed. The term "phase adjusting"—also designated Mozer phase adjusting—comprises the steps of Fourier transforming a periodic time signal to derive frequency components whose phases are adjusted such that the resulting inverse Fourier transform is a time-symmetric pitch period waveform whereby one-half of the original pitch period is made redundant. The technique termed "phoneme blending" comprises the step of storing portions of input signals corresponding to selected phonemes and phoneme groups according to their ability to blend naturally with any other phoneme. The technique termed "pitch period repetition" comprises the steps of selecting signals representative of certain phonemes and phoneme groups from information input signals and storing only portions of these selected signals corresponding to every nth pitch period of the wave form while storing instruction signals specifying which phonemes and phoneme groups have been so selected and the value of n. The technique termed "multiple use of syllables" comprises the steps of separating signals representative of spoken words into two or more parts, with such parts of later words that are identical to parts of earlier words being deleted from storage in a memory while instruction signals specifying which parts are deleted are also stored. The technique termed "floating zero, two-bit delta modulation" comprises the steps of delta modulating digital signals corresponding to information input signals prior to storage in a first memory by setting the value of the ith digitization of the sampled signal equal to the value of the $(i-1)$th digitization of the sampled signals plus $f(\Delta_{i-1}, \Delta_i)$ where $f(\Delta_{i-1}, \Delta_i)$ is an arbitrary function having the property in a specific embodiment that changes of wave form of less than two levels from one digitization to the next are reproduced exactly while greater changes in either direction are accommodated by slewing in either direction by three levels per digitization. Preferably, the phase adjusting technique includes the step of selecting the representative symmetric wave form which has a minimum amount of power in one-half of the period being analyzed and which possesses the property that the difference between amplitudes of successive digitizations during the other half period of the selected wave form are consistent with possible values obtainable from the delta modulation step. The techniques, in addition to taking the time derivative and time quantizing the signal information, involve discarding portions of the complex waveform within each period of the waveform, e.g. a portion of the pitch period where the waveform represents speech and multiple repetitions of selected waveform periods while discarding other periods. In the case of speech waveforms, the presence of certain phonemes are detected and/or generated and are multiply repeated as are syllables formed of certain phonemes. Furthermore, certain of the speech information is selectively delta modulated according to an arbitrary function, to be described, which allows a compression factor of approximately two while preserving a large amount of speech intelligibility.

In contrast to the goals of earlier speech synthesis research to reproduce an unlimited vocabulary, the present invention has resulted from the desire to develop a speech synthesizer having a limited vocabulary on the order of one hundred words but with a physical size of less than about 0.25 inches square. This extremely small physical size is achieved by utilizing only digital techniques in the synthesis and by building the resulting circuit on a single LSI (large scale integration) electronic chip of a type that is well known in the fabrication of electronic calculators or digital watches. These goals have precluded the use of vocoder technology and resulted in the development of a synthesizer from wholly new concepts. By uniquely combining the above mentioned, newly developed compression techniques with known compression techniques, the present invention is able to compress information sufficient for such multi-word vocabulary onto a single LSI chip without significantly compromising the intelligibility of the original information.

The uses for compact synthesizers produced in accordance with the invention are legion. For instance, such a device can serve in an electronic calculator as a means for providing audible results to the operator without requiring that he shift his eyes from his work. Or it can be used to provide numbers in other situations where it is difficult to read a meter. For example, upon demand it could tell a driver the speed of his car, it could tell an electronic technicision the voltage at some point in his circuit, it could tell a precision machine operator the information he needs to continue his work, etc. It can also be used in place of a visual readout for an electronic timepiece. Or it could be used to give verbal messages under certain conditions. For example, it could tell an automobile driver that his emergency brake is on, or that his seatbelt should be fastened, etc. Or it could be used for communication between a computer and man, or as an interface between the operator and any mechanism, such as a pushbutton telephone, elevator, dishwasher, etc. Or it could be used in novelty devices or in toys such as talking dolls.

The above, of course, are just a few examples of the demand for compact units. The prior art has not been able to fill this demand, because presently available, unlimited vocabulary speech synthesizers are too large, complex and costly. The invention, hereinafter to be described in greater detail, provides an apparatus for relatively simple and inexpensive speech synthesis which, in the preferred embodiment, uses basically digital techniques.

It is therefore an object of the present invention to provide a compact speech synthesizer.

It is another object of the present invention to provide a speech synthesizer using only one or a few LSI or equivalent electronic chips each having linear dimensions of approximately $\frac{1}{4}$ inch on a side.

It is still another object of the invention to provide a speech synthesizer using basically digital rather than analog techniques.

It is a further object of the present invention to provide a speech synthesizer in which the information content of the phoneme waveform is compressed by storing only selected portions of that waveform.

It is still a further object of the present invention to provide a speech synthesizer in which syllables can be accented and other pitch period variations of the speech sound, such as inflections, can be generated.

It is yet another object of the present invention to provide a speech synthesizer in which amplitude changes at the beginning and end of each word and silent intervals within and between words can be simulated.

Yet a further object of the present invention is to provide a speech synthesizer capable of being manufactured at low cost.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 5:
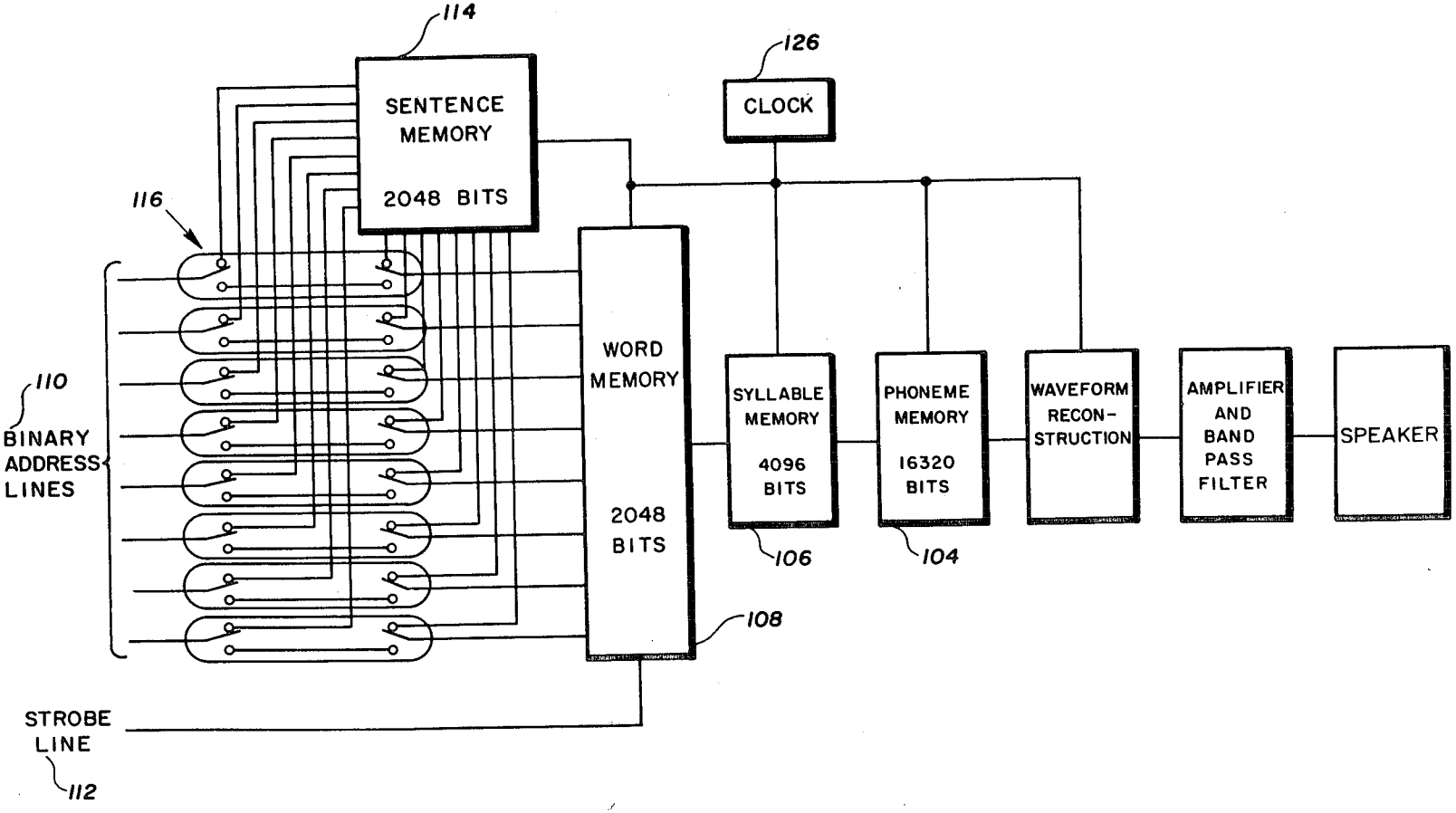
FIG. 5 is a simplified block diagram of a speech synthesizer illustrating the storage and retrieval method of the present invention.
Figure 9:
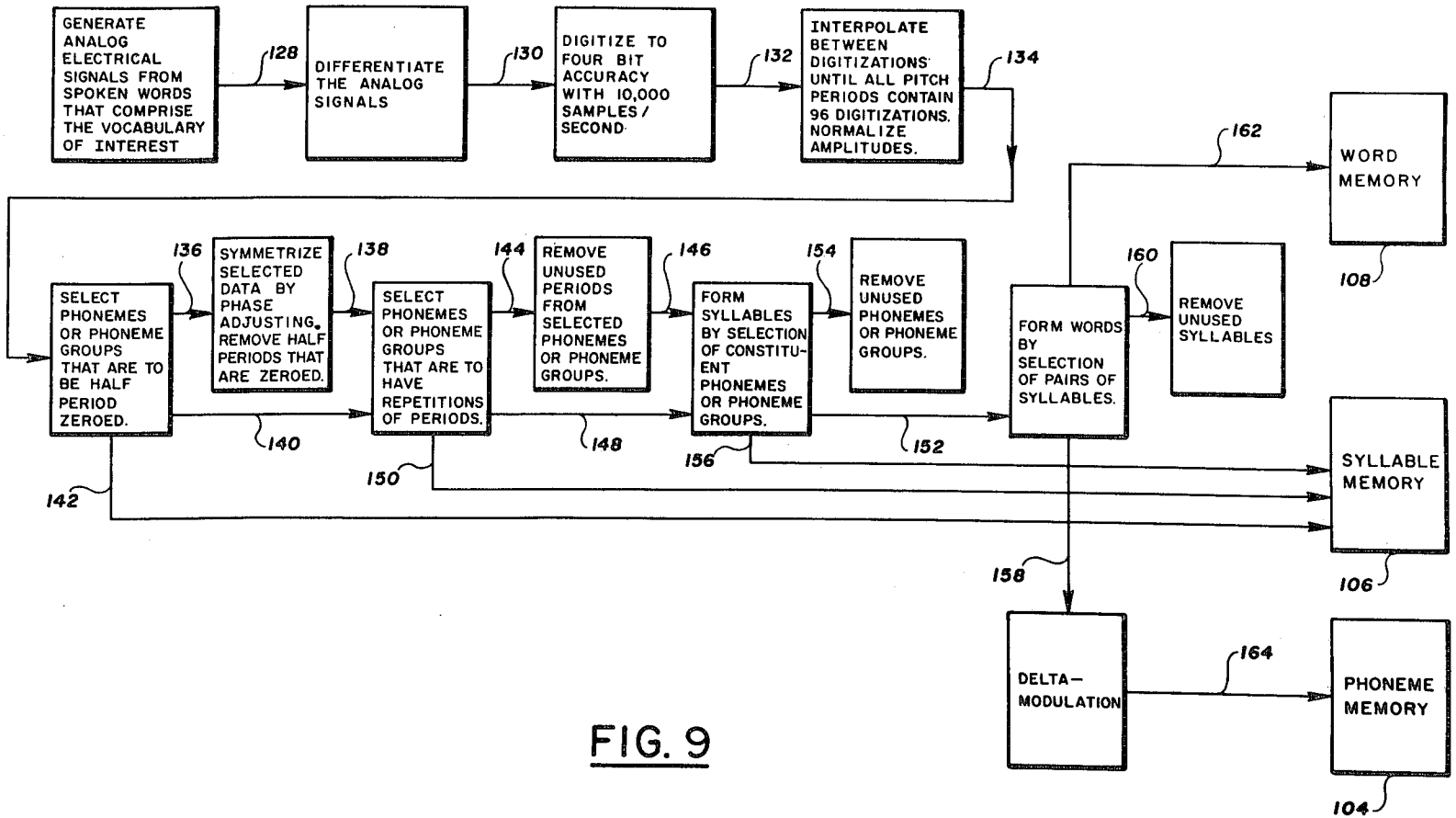
FIG. 9 is a block diagram illustrating the methods of analysis for generating the information in the phoneme, syllable, and word memories of the speech synthesizer according to the invention.

A block diagram of the preferred embodiment of the speech synthesizer 103 according to the invention is given in FIG. 5. It should be understood, however, that the initial programming of the elements of this block diagram by means of a human operator and a digital computer will be discussed in detail in reference to FIG. 9. The synthesizer phoneme memory 104 stores the digital information pertinent to the compressed waveforms and contains 16,320 bits of information. The synthesizer syllable memory 106 contains information signals as to the locations in the phoneme memory 104 of the compressed waveforms of interest to the particular sound being produced and it also provides needed information for the reconstruction of speech from the compressed information in the phoneme memory 104. Its size is 4096 bits. The synthesizer word memory 108, whose size is 2048 bits, contains signals representing the locations in the syllable memory 106 of information signals for the phoneme memory 104 which construct syllables that make up the word of interest.

To recreate the compressed speech information stored in the speech synthesizer a word is selected by impressing a predetermined binary address on the seven address lines 110. This word is then constructed electronically when the strobe line 112 is electrically pulsed by utilizing the information in the word memory 108 to locate the addresses of the syllable information in the syllable memory 106, and in turn, using this information to locate the address of the compressed waveforms in the phoneme memory 104 and to ultimately reconstruct the speech waveform from the compressed data and the reconstruction instructions stored in the syllable memory 106. The digital output from the phoneme memory 104 is passed to a delta-modulation decoder circuit 184 and thence through an amplifier 190 to a speaker 192. The diagram of FIG. 5 is intended only as illustrative of the basic functions of the synthesizer portion of the invention; a more detailed description is given in reference to FIG. 10 hereinafter.

Groups of words may be combined together to form sentences in the speech synthesizer through addressing a 2048 bit sentence memory 114 from a plurality of external address lines 110 by positioning seven, double-pole double-throw switches 116 electronically into the configuration illustrated in FIG. 5.

The selected contents of the sentence memory 114 then provide addresses of words to the word memory 108. In this way, the synthesizer is capable of counting from 1 to 40 and can also be operated to selectively say such things as: "3.5+7−6=4.5," "1942 over 0.0001=overflow," "2×4=8," "4.2 volts dc," "93 ohms," "17 amps ac," "11:37 and 40 seconds, 11:37 and 50 seconds," "3 up, 2 left, 4 down," "6 pounds 15 ounces equals 8 dollars and 76 cents," "55 miles per hour," and "2 miles equals 3218 meters, equals 321869 centimeters," for example.

Compression Techniques

As described above, the basic content of the memories 108, 106 and 104 is the end result of certain speech compression techniques subjectively applied by a human operator to digital speech information stored in a computer memory. In actual practice, certain basic speech information necessary to produce the one hundred and twenty-eight word vocabulary is spoken by the human operator into a microphone, in a nearly monotone voice, to produce analog electrical signals representative of the basic speech information. These analog signals are next differentiated with respect to time. This information is then stored in a computer and is selectively retrieved by the human operator as the speech programming of the speech synthesizer circuit takes place by the transfer of the compressed data from the computer to the synthesizer. This process is explained in greater detail in the referenced U.S. Pat. No. 4,214,125 in reference to FIG. 9.

Aside from the compression techniques summarized above, the speech synthesizer of the invention incorporates other features which aid in the intelligibility and quality of the reproduced speech. These features will now be discussed in detail.

Pitch Frequency Variations

The clock 126 in FIG. 5 controls the rate at which digitizations are played out of the speech synthesizer. If the clock rate is increased the frequencies of all components of the output waveform increase proportionally. The clock rate may be varied to enable accenting of syllables and to create rising or falling pitches in different words. Via tests on a computer it has been shown that the pitch frequency may be varied in this way by about 10 percent without appreciably affecting sound quality or intelligibility. This capability can be controlled by information stored in the syllable memory 106 although this is not done in the prototype speech synthesizer. Instead, the clock frequency is varied in the following two manners.

First, the clock frequency is made to vary continuously by about two percent at a three Hertz rate. This oscillation is not intelligible as such in the output sound but it results in the disappearance of the annoying monotone quality of the speech that would be present if the clock frequency were constant.

Second, the clock frequency may be changed by plus or minus five percent by manually or automatically closing one or the other of two switches associated with the synthesizer's external control. Such pitch frequency variations allow introduction of accents and inflections into the output speech.

The clock frequency also determines the highest frequency in the original speech waveform that can be reproduced since this highest frequency is half the digitization or clock frequency. In the speech synthesizer of the preferred embodiment, the digitization or clock frequency has been set to 10,000 Hertz, thereby allowing speech information at frequencies to 5000 Hertz to be reproduced. Many phonemes, especially the fricatives, have important information above 5000 Hertz, so their quality is diminished by this loss of information. This problem may be overcome by recording and playing all or some of the phonemes at a higher frequency at the expense of requiring more storage space in the phoneme memory in other embodiments.

Amplitude Variations

The present invention further provides for variations in the amplitude of each phoneme. Amplitude variations may be important in order to simulate naturally occurring amplitude changes at the beginning and ending of most words and to emphasize certain words in sentences. Such changes may also occur at various places within a word. These amplitude changes may be achieved by storing appropriate information in the syllable memory 106 of FIG. 5 to control the gain of the output amplifier 190 as the phoneme is read out of the phoneme memory. Although this feature has not been shown in the speech synthesizer of FIG. 5 for simplicity of description, it should be understood to be a necessary part of more sophisticated embodiments.

In the generation of the phonemes and phoneme groups of the synthesizer of the preferred embodiment, care was taken to keep the amplitude of the spoken data constant so that phonemes or phoneme groups from different utterances could be combined with no audible discontinuity in the amplitude.

The electronic circuitry necessary to reproduce and thus synthesize a one hundred and twenty-eight word vocabulary will now be described in reference to FIG. 10. An overview of the operation of the synthesizer electronics is illustrated in the block diagram of FIG. 10. Depending on the state of the word/sentence switch 166, it is possible to address either individual words or entire sentences. Consider the former case. With the word/sentence switch 166 in the "word" position, the seven address switches 168 are connected directly through the data selector switch 170 to the address input of the word memory 108. Thus the number set into the switches 168 locates the address in the word memory 108 of the word which is to be spoken.

The output of the word memory 108 addresses the location of the first syllable of the word in the syllable memory 106 through a counter 178. The output of the syllable memory 106 addresses the location of the first phoneme of the syllable in the phoneme memory 104 through a counter 180. The purpose of the counters 178 and 180 will be explained in greater detail below. The output of the syllable memory 106 also gives information to a control logic circuit 172 concerning the compression techniques used on the particular phoneme. (The exact form of this information is detailed in the description of the syllable memory 106 in the referenced U.S. Pat. No. 4,214,125).

When a start switch 174 is closed, the control logic 172 is activated to begin shifting out the contents of the phoneme memory 104, with appropriate decompression procedures, through the output of a shift register 176 at a rate controlled by the clock 126. When all of the bits of the first phoneme have been shifted out (the instructions for how many bits to take for a given phoneme are part of the information stored in the syllable memory 106), the counter 178, whose output is the 8-bit binary number s, is advanced by the control logic 172 and the counter 180, whose output is the 7-bit binary number p, is loaded with the beginning address of the second phoneme to be reproduced.

When the last phoneme of the first syllable has been played, a type J-K flip-flop 182 is toggled by the control logic 172, and the address of the word memory 108 is advanced one bit to the second syllable of the word. The output of the word memory 108 now addresses the location of the beginning of the second syllable in the syllable memory 106, and this number is loaded into the counter 178. The phonemes which comprise the second syllable of the word which is being spoken are next shifted through the shift register 176 in the same manner as those of the first syllable. When the last phoneme of the second syllable has been spoken, the machine stops.

The operation of the control logic 172 is sufficiently fast that the stream of bits which is shifted out of the shift register 176 is continuous, with no pauses between the phonemes. This bit stream is a series of 2-bit pieces of delta-modulated amplitude information which are operated on by a delta modulation decoder circuit 184 to produce a 4-bit binary number $v_i$ which changes 10,000 times each second. A digital to analog converter 186, which is a standard R-2R ladder circuit, converts this changing 4-bit number into an analog representation of the speech waveform. An electronic switch 188, shown connected to the output of the digital to analog converter 186, is toggled by the control logic 172 to switch the system output to a constant level signal which provides periods of silence within and between words, and within certain pitch periods in order to perform $\frac{1}{2}$-period zeroing operation. The control logic 172 receives its silence instructions from the syllable memory 106. This output from the switch 188 is filtered to reduce the signal at the digitizing frequency and the pitch period repetition frequency by the filter-amplifier 190, and is reproduced by the loudspeaker 192 as the spoken word of the vocabulary which was selected. The entire system is controlled by a 20 kHz clock 126, the frequency of which is modulated by a clock modulator 194 to break up the monotone quality of the sound which would otherwise be present as discussed above.

The operation of the synthesizer 103 with the word/-sentence switch 166 in the "sentence" position is similar to that described above except that the seven address switches 168 specify the location in the sentence memory 114 of the beginning of the sentence which is to be spoken. This number is loaded into a counter 196 whose output is an 8-bit number j which forms the address of the sentence memory 114. The output of the sentence memory 114 is connected through the data selector switch 170 to the address input of the word memory 108. The control logic 172 operates in the manner described above to cause the first word in the sentence to be spoken, then advances the counter 196 by one count and in a similar manner causes the second word in the sentence to be spoken. This continues until a location in the sentence memory 114 is addressed which contains a stop command, at which time the machine stops.

Figure 10:
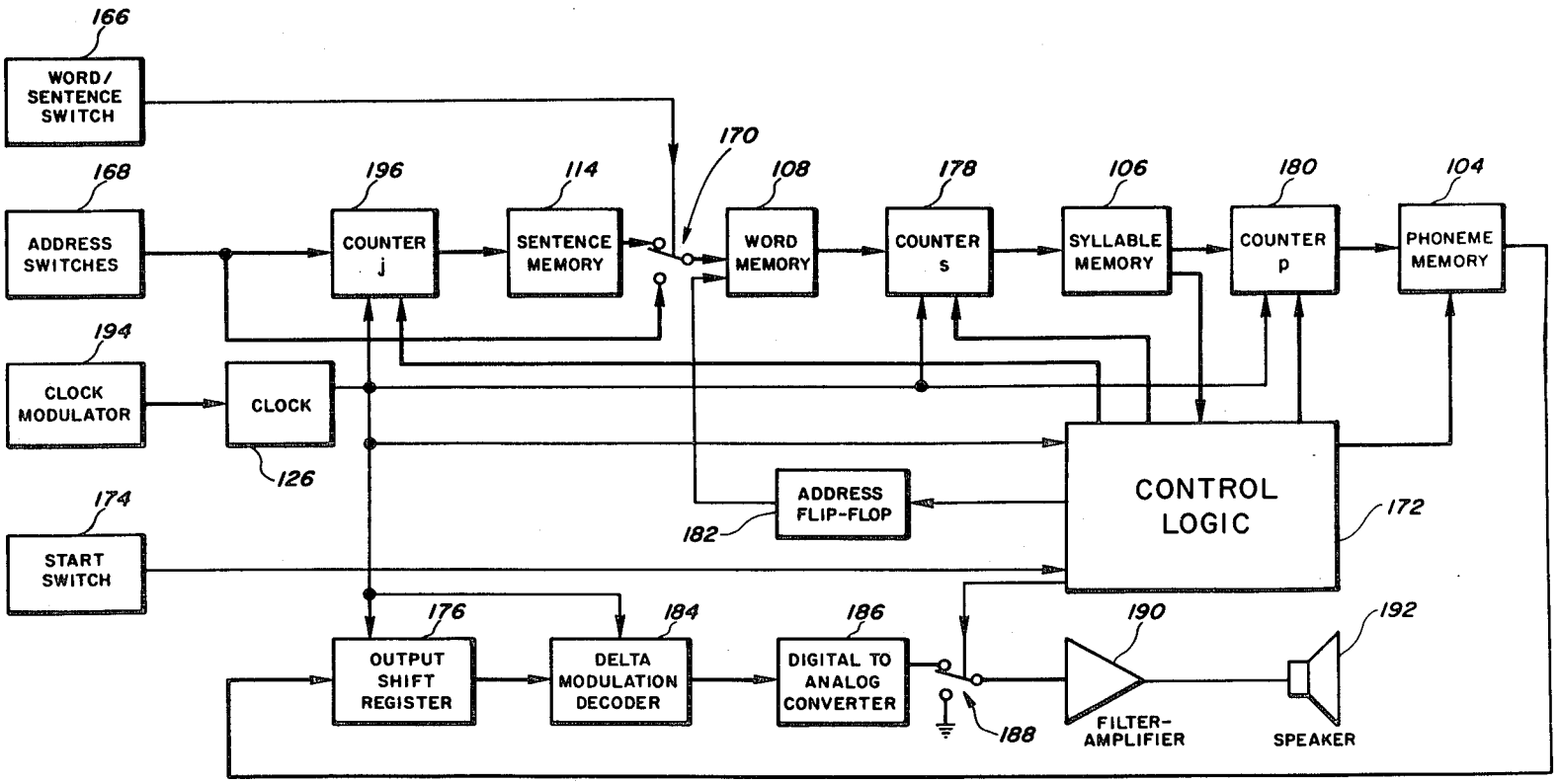
FIG. 10 is a block diagram of the synthesizer electronics of the preferred embodiment of the invention.
Figure 11A:
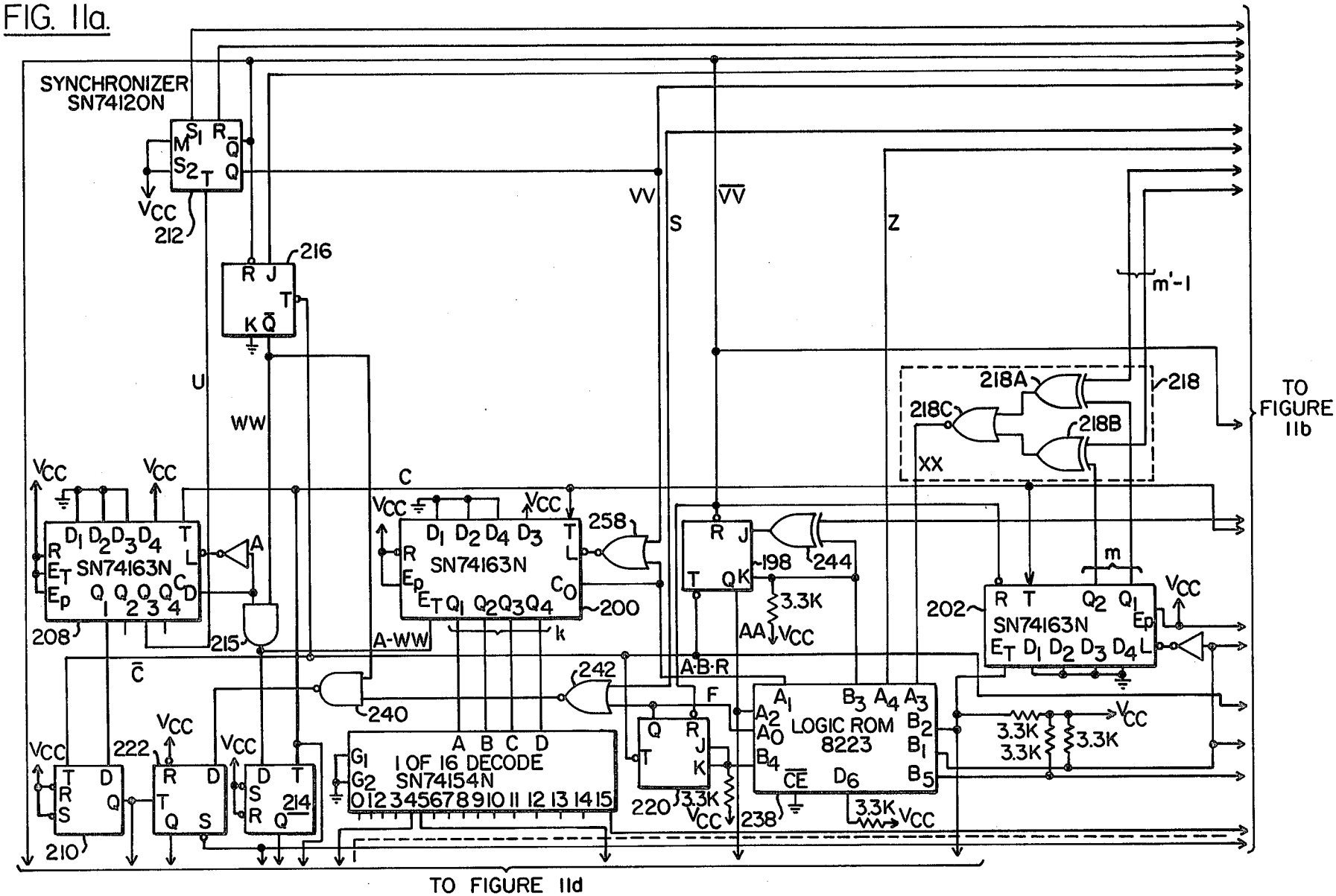
FIGS. 11*a*–11*f* are schematic circuit diagrams of the electronics depicted in block form in FIG. 10.
Figure 11B:
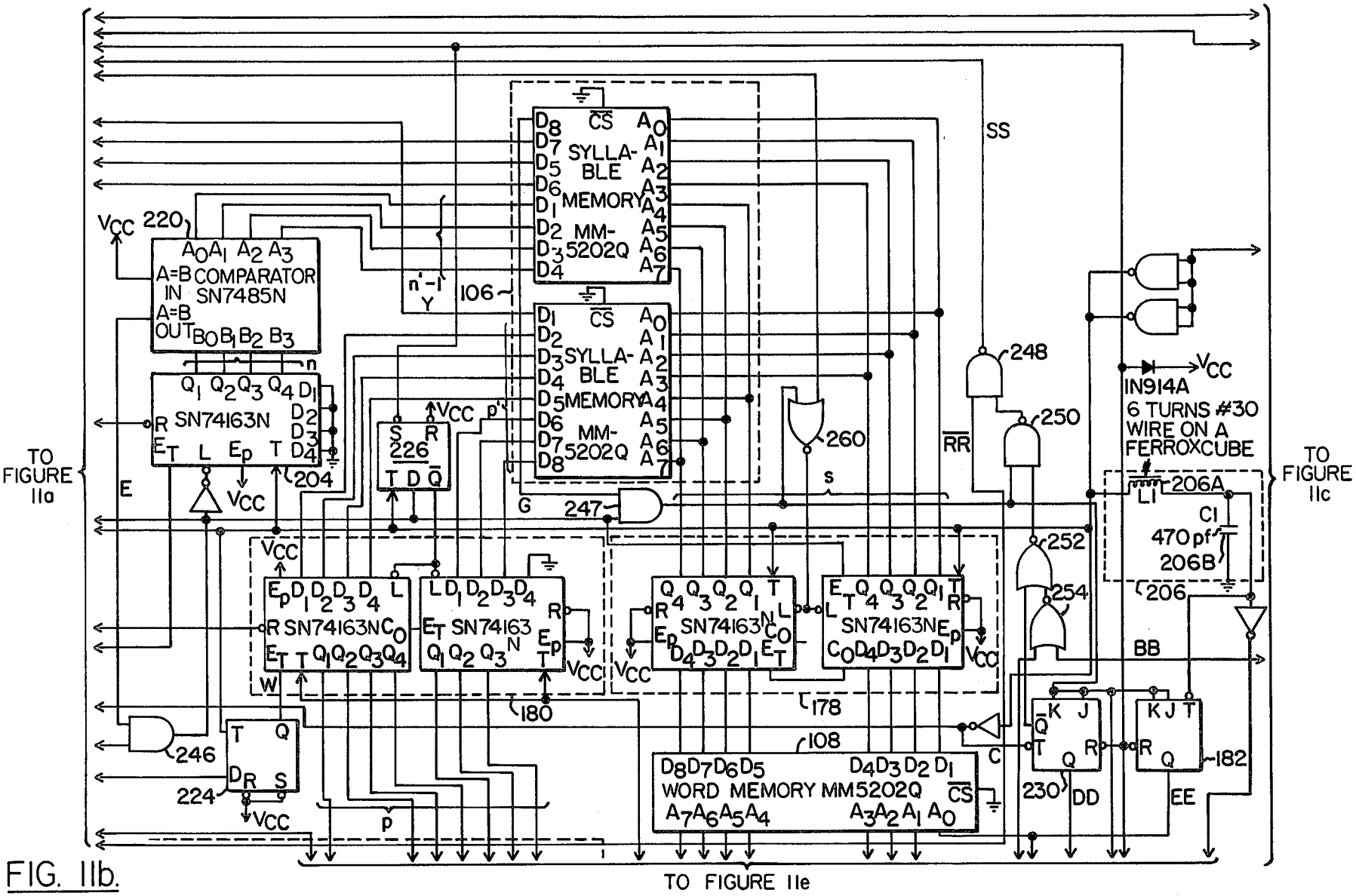
Figure 11C:
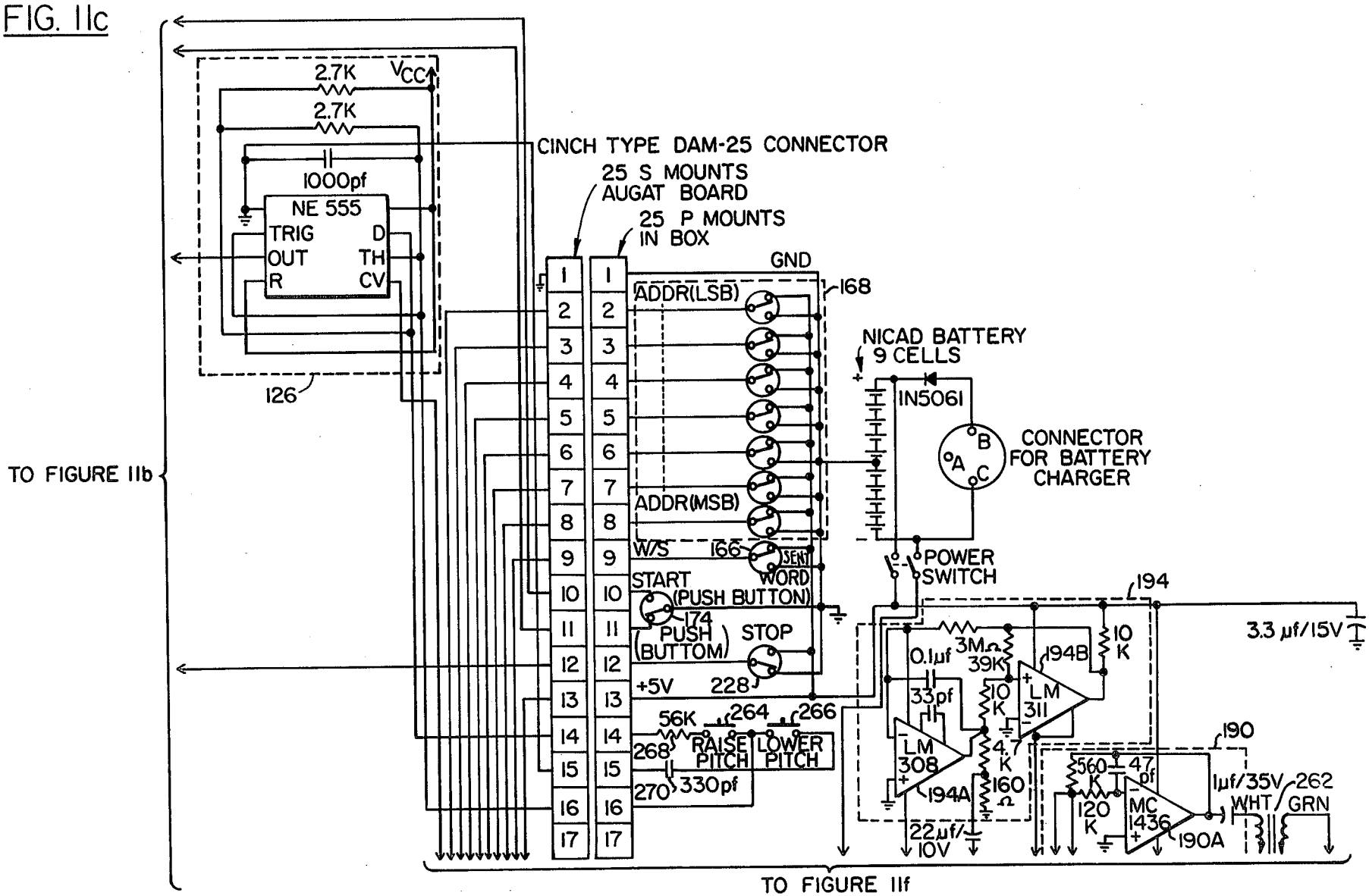
Figure 11D:
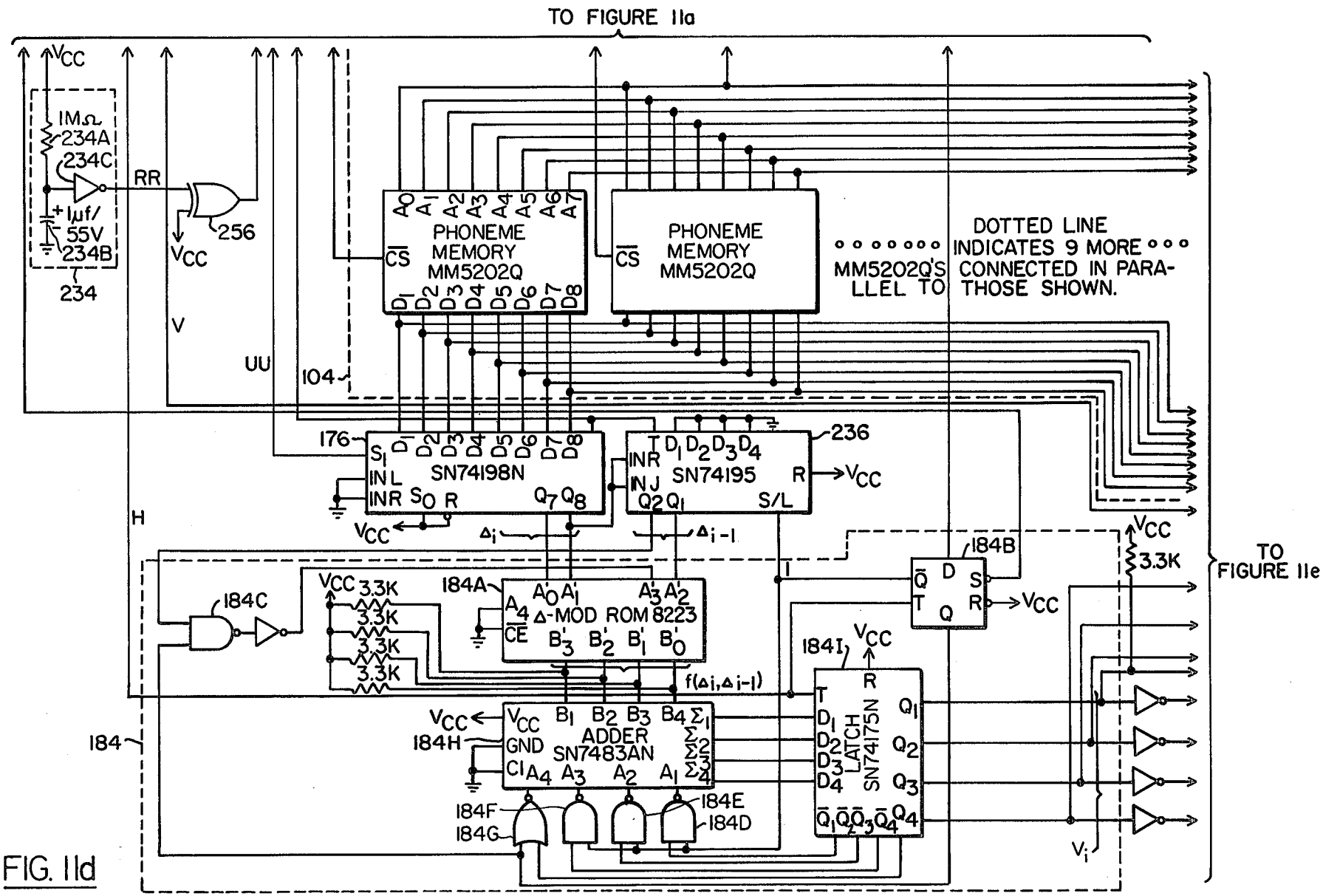
Figure 11E:
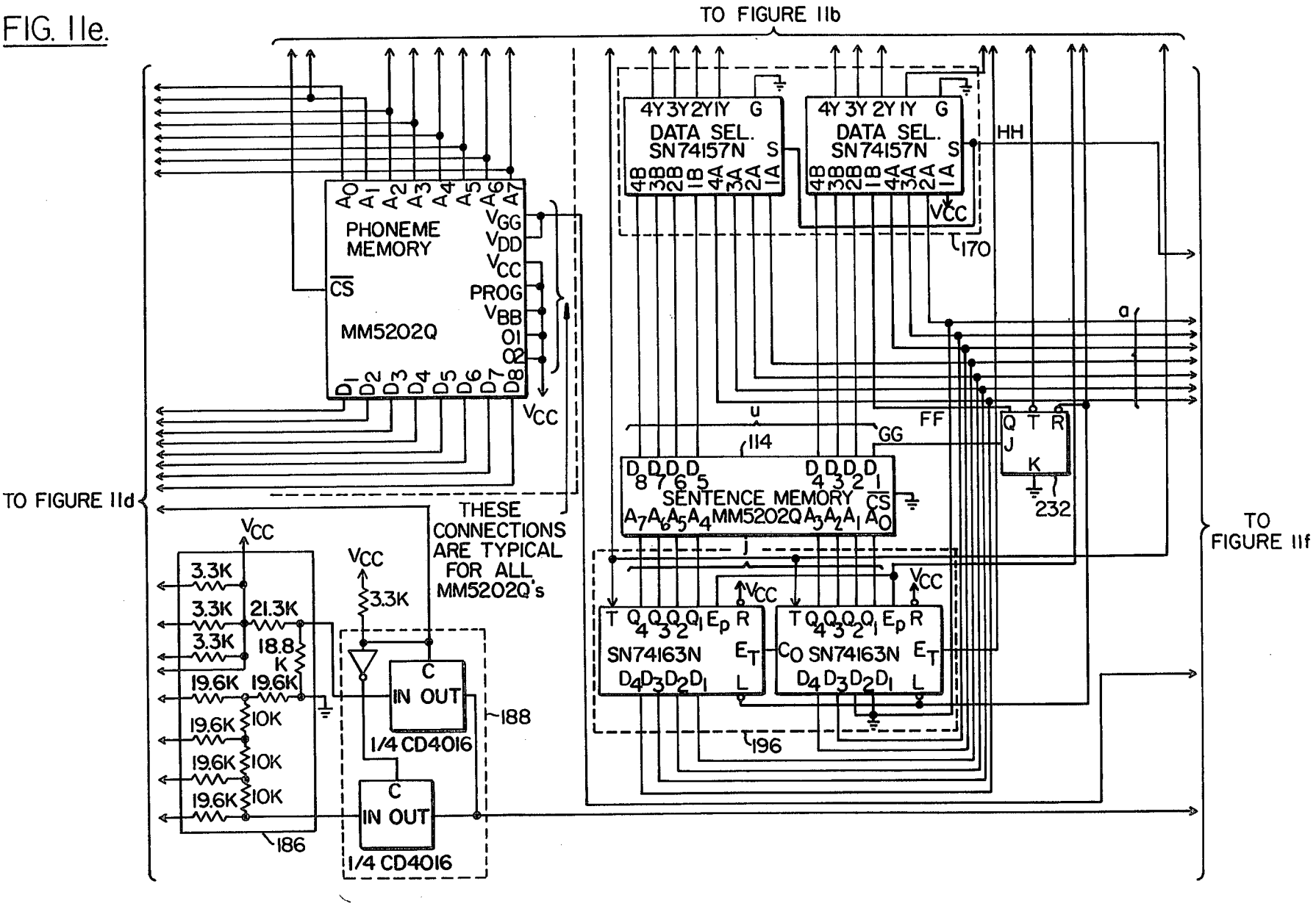
Figure 11F:
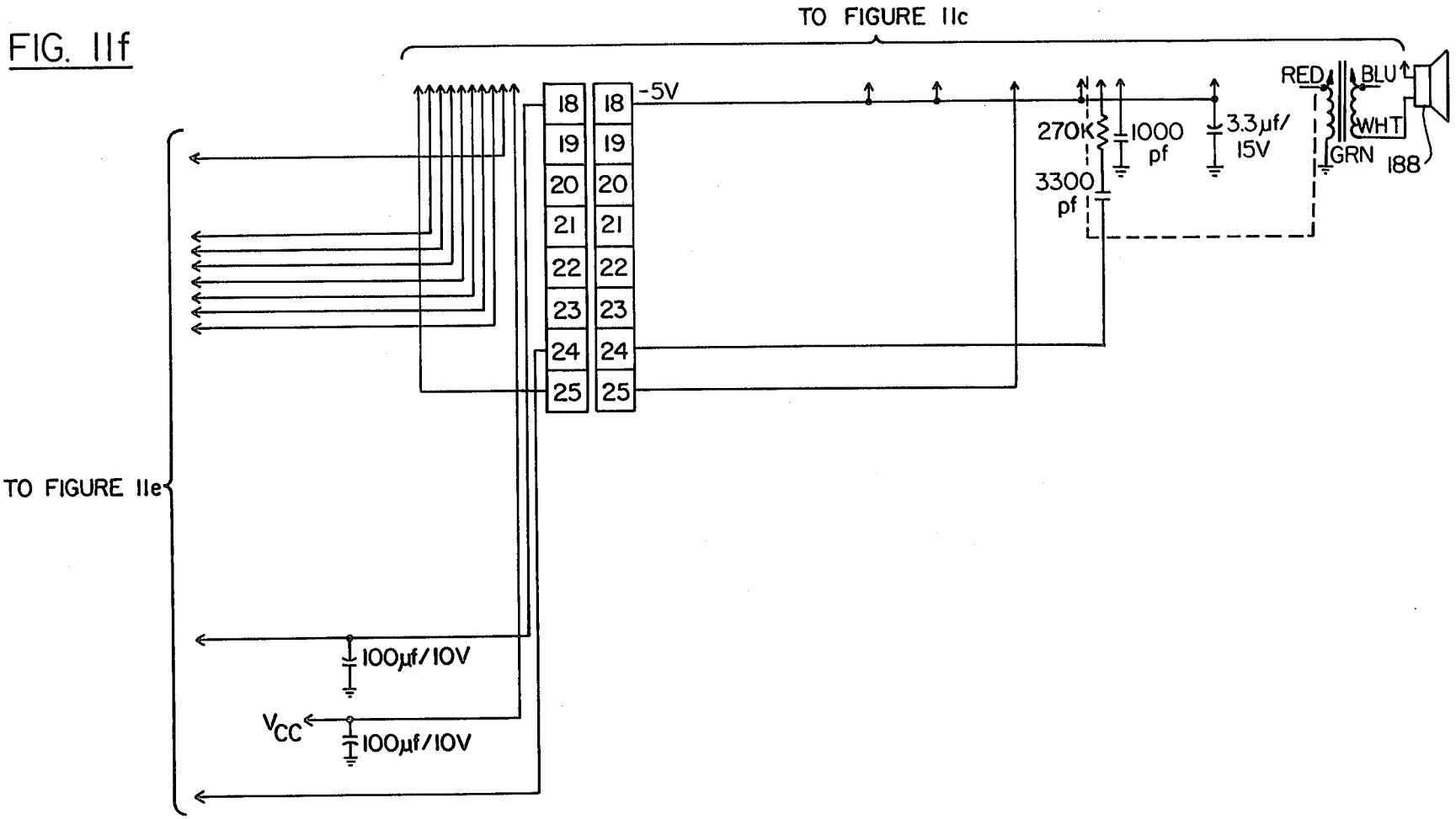
Figure 12:
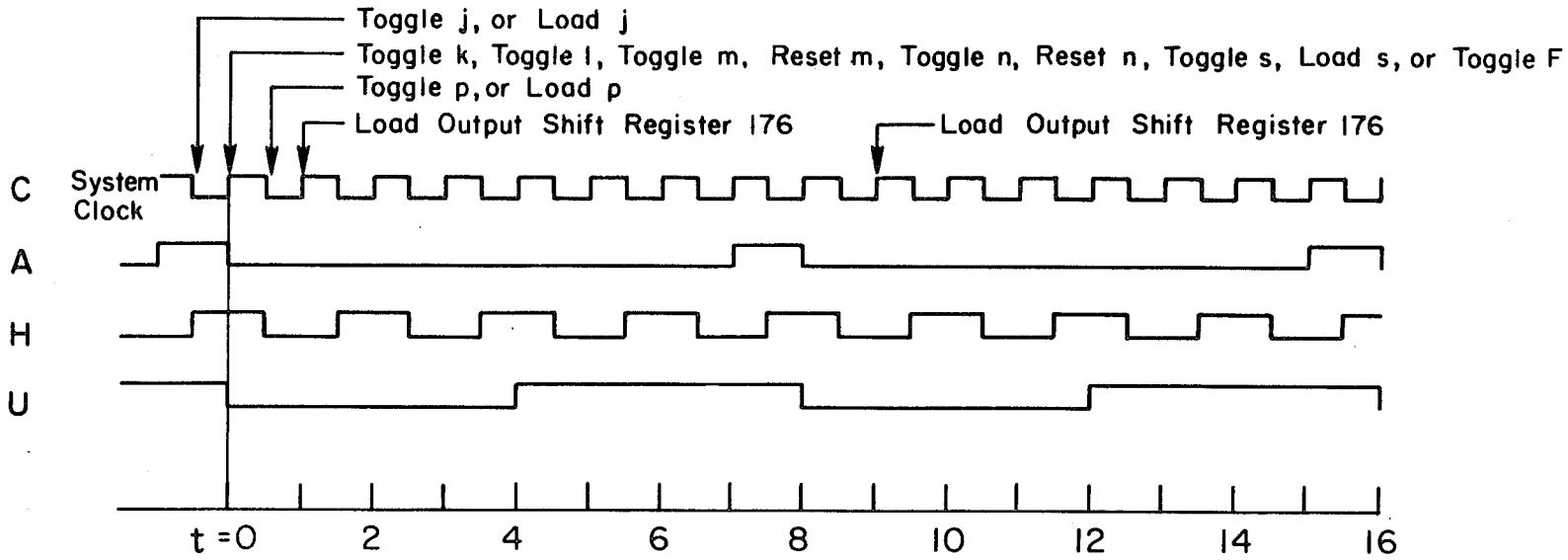
FIG. 12 is a logic timing diagram which illustrates the four clock waveforms used in the synthesizer electronics, along with the times at which various counters and flip-flops are allowed to change state.

To further understand the detailed operation of the system of FIG. 10, reference should be had to the logic circuit description with reference to FIGS. 11–16 in the referenced U.S. Pat. No. 4,214,125.

While specific electronic circuitry has been shown for carrying out the preferred embodiment of the invention, it should be apparent that in other embodiments, other logic circuitry could be used to carry out the same method. Furthermore, although no specific logic circuitry has been described for automatically programming the memory units of the speech synthesizer, such circuitry is within the skill of the art given the teachings of the basic synthesizer in the description above.

For the sake of simplicity in this description, the automatic circuitry required to close certain of the switches, such as the start switch 174 and the address switches 168, for example, has been omitted. It will, of course, be understood that in certain embodiments these switches are merely representative of the outputs of peripheral apparatus which adapt the speech synthesizer of the invention to a particular function, e.g., as the spoken output of a calculator.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claims.

What is claimed is:

1. A speech synthesizer comprising: means for storing compressed digital signals corresponding to original information speech or other audio wave form time domain signals, said digital signals including information signals portions and instructions signals portions identifying particular compression techniques applied to associated information signal portions;

means for manifesting analog electrical synthesized signals corresponding to said original signals;

digital-to-analog converter means having an output coupled to said manifesting means, and an input; and intermediate signal processing means having an input means coupled to said storing means for receiving said information portions and said instruction signal portions of said digital signals stored in said storing means, and an output means coupled to said digital-to-analog converter means, for expanding said information signal portions in accordance with said instruction signal portions to produce digital synthesized signals to be converted to said analog synthesized signals by said digital-to-analog converter means.

2. The combination of claim 1 wherein said information signal portions include delta modulated signal portions identified by corresponding instruction signal portions, and wherein said intermediate signal processing means includes delta modulation decoder means for decoding said delta modulated signal portions.

3. The combination of claim 1 wherein said information signal portions include X period zeroed signals formed by deleting preselected relatively low power portions of said original information time domain signals, where X is a fraction in the range from about $\frac{1}{4}$ to about $\frac{3}{4}$, the corresponding instruction signal portions specifying those portions of the deleted signals to be replaced by a substantially constant amplitude signal of predetermined value, and wherein said intermediate signal processing means includes control means responsive to receipt of an X period zeroed instruction signal portion for causing the generation of a substantially constant amplitude signal having a single value lying between the maximum and minimum values of the corresponding deleted portion of the original information-bearing time domain signal as a portion of the synthetic analog signal manifested by said manifesting means.

4. The combination of claim 3 wherein said synthesizer further includes source means for generating said substantially constant amplitude signal, and switch means having an output terminal coupled to said manifesting means, a first input terminal coupled to said output of said digital-to-analog converter means, a second input terminal coupled to said source means, a control input terminal coupled to said control means, and means for coupling said second input terminal of said switch means to said output terminal of said switch means in response to a control signal from said intermediate signal processing means indicating receipt by said intermediate signal processing means of an X period zeroed instruction signal.

5. The combination of claim 1 wherein said intermediate signal processing means includes variable clock means for varying the pitch frequency of said digital synthesized signals so that said analog electrical synthesized signals contain synthesized naturally occurring pitch period variations.

6. The combination of claim 1 wherein said information signal portions include an inverse transformation of a Mozer phase adjusted transform of said original time domain signals identified by corresponding instruction signal portions, and wherein said intermediate signal processing means includes means responsive to receipt of a Mozer phase adjust instruction signal portion for causing the corresponding compressed digital signals stored in said storing means to be sequentially applied to said converter means in a first ordered manner and subsequently causing the same signals to be sequentially applied to said converter means in a reverse manner from said first ordered manner.

7. The combination of claim 1 wherein said storing means includes a phoneme memory for storing digital information signal portions representative of a vocabulary of phonemes used in synthesizing words, a syllable memory for storing digital instruction signal portions specifying the starting address in said phoneme memory of each of said digital information signal portions used in synthesizing a library of words and specific instruction signal portions for specifying the sequential read-out of said phoneme digital information signal portions, and a word memory for storing digital instructions signal portions representing the starting address in said syllable memory of said syllable digital information signal portions required to construct the syllables of a library of words, and wherein said synthesizer further includes means coupled to said word memory for generating a signal specifying a particular word of interest for synthesization.

8. The combination of claim 7 wherein said intermediate signal processing means includes a phoneme counter having an address input coupled to said syllable memory for receiving said syllable digital instruction signals, means for incrementing said phoneme counter to enable sequential read-out of said phoneme digital information signal portions comprising a complete syllable of a specified word, a syllable counter having an address input coupled to said word memory for receiving said word digital instruction signals, and means for incrementing said syllable counter to enable sequential read-out of said syllable digital address instruction signal portions and said digital sequential read-out instruction signals comprising a complete word.

9. The combination of claim 7 wherein said storing means further includes a sentence memory for storing digital information signal portions specifying the starting address in said word memory of said word instruction signal portions for said library of words, and means coupled to said sentence memory for generating a signal specifying a particular sentence for synthesization.

10. The combination of claim 9 wherein said intermediate signal processing means includes a phoneme counter having an address input coupled to said syllable memory for receiving said syllable digital instruction signals, means for incrementing said phoneme counter to enable sequential read-out of said phoneme digital information signal portions comprising a complete syllable of a specified word, a syllable counter having an address input coupled to said word memory for receiving said word digital instruction signals, means for incrementing said syllable counter to enable sequential read-out of said syllable digital address instruction signal portions and said digital sequential read-out instruction signals comprising a complete word, a sentence counter having an address input coupled to said sentence signal generating means for receiving a sentence specifying signal, and means for incrementing said sentence counter to enable sequential read-out of said word digital instruction signal portions comprising a complete sentence.

11. The combination of claim 1 wherein said intermediate signal processing means further includes a shift register coupled to said storing means for temporarily storing said digital information signal portions received therefrom.

* * * * *